United States Patent [19]

Petro

[11] 4,186,327

[45] Jan. 29, 1980

[54] SAFETY SWITCH WHICH RENDERS HIGH INTENSITY DISCHARGE LAMP INOPERATIVE ON ACCIDENTAL BREAKAGE OF OUTER ENVELOPE

[75] Inventor: John Petro, Belleville, N.J.

[73] Assignee: Westinghouse Electric Corp., Pittsburgh, Pa.

[21] Appl. No.: 777,864

[22] Filed: Mar. 15, 1977

[51] Int. Cl.[2] ..... H01J 7/44; H01J 17/34; H01J 23/16; H01K 1/62

[52] U.S. Cl. ..... 315/73; 315/74; 315/106; 315/117; 313/17

[58] Field of Search ..... 315/73, 74, 75, 47, 315/60, 119, 125, 106, 107; 313/17, 227

[56] References Cited

U.S. PATENT DOCUMENTS

| | | | |
|---|---|---|---|
| 4,013,919 | 3/1977 | Corbley | 315/74 |
| 4,013,920 | 3/1977 | Petro | 315/107 |
| 4,032,816 | 6/1977 | Rokosz | 315/73 |
| 4,039,893 | 8/1977 | Corbley | 315/73 |
| 4,143,301 | 3/1979 | Strauss et al. | 315/73 |

*Primary Examiner*—Saxfield Chatmon, Jr.
*Attorney, Agent, or Firm*—R. S. Lombard

[57] ABSTRACT

An HID lamp utilizes a thin, fragile, strip-like conductor member affixed to and carried on a portion of the inner surface of the lamp protective envelope. Upon breakage of the protective envelope, the fragile conductor will break and interrupt the electrical continuity of the lamp's electrical circuit, thereby rendering the lamp inoperative.

10 Claims, 4 Drawing Figures

SAFETY SWITCH WHICH RENDERS HIGH INTENSITY DISCHARGE LAMP INOPERATIVE ON ACCIDENTAL BREAKAGE OF OUTER ENVELOPE

CROSS-REFERENCE TO RELATED APPLICATIONS

In copending application Ser. No. 607,411, filed Aug. 25, 1975 by R. H. Atkinson, and owned by the present assignee, is disclosed an HID lamp which has an oxidizable link positioned between the outer protective envelope and the arc tube and electrically connected in series with one of the lamp electrodes. Under normal lamp operating conditions, the link is heated to an incandescent condition. If the outer envelope is accidentally broken, the link rapidly oxidizes and breaks to open the arc tube energizing circuit and render the lamp inoperative.

In copending application Ser. No. 649,775, filed Jan. 16, 1976 by F. Rokosz, which in turn is a continuation-in-part of copending application Ser. No. 609,138, filed Aug. 29, 1975, and owned by the present assignee, is disclosed an HID lamp which has a spring-loaded safety switch positioned between the outer protective envelope and the arc tube and electrically connected in series with one of the lamp electrodes. When the lamp is operating normally, the safety switch is maintained in the closed position, but if the outer envelope is accidentally broken, the switch automatically opens to break the lamp energizing circuit and render the lamp inoperative.

In copending application Ser. No. 651,306, filed on Jan. 22, 1976 by J. Petro, the present applicant, and owned by the present assignee, is disclosed an HID lamp which has a resilient safety switch positioned proximate the inner surface of the dome portion of the protective outer envelope in contact with an extremity of a resilient leafspring portion of the arc tube frame, to maintain the switch in a closed position and which functions in the same manner as the switch of the aforesaid Rokosz application.

BACKGROUND OF THE INVENTION

It has been reported that high-intensity discharge (HID) lamps, such as high-pressure, mercury-vapor lamps, can constitute a safety hazard if the outer envelope is broken and the lamp continues to operate, because of the generation of short wavelength ultraviolet radiations which are passed by the quartz arc tube. Lamps which are protected by a fuse are generally known in the art and a projection lamp which is fused in order to prevent dangerous arcing currents is described in U.S. Pat. No. 2,859,381 dated Nov. 4, 1958.

High-intensity discharge lamps have also been provided with an incandescent filament included between an arc tube and the outer envelope for purposes of ballasting the discharge and also generating some visible light. While the purpose of ballasting the light-generating filament is not that of a link or safety switch, such a filament will normally oxidize and fail, particularly under lamp start-up conditions, if the outer envelope is broken since this permits the filament to come in contact with air. Of course, such a supplemental ballasting filament consumes an appreciable portion of the total power consumed by the lamp, which decreases the lamp operating efficiency.

SUMMARY OF THE INVENTION

The basic HID lamp comprises an elongated radiation-transmitting arc tube which is enclosed by and supported within a light-transmitting protective envelope which is opaque to short-wavelength ultraviolet radiations. The arc tube encloses a discharge-sustaining filling and electrodes are operatively positioned therein proximate the ends thereof. Electrical lead-in members are sealed through the arc tube and connected to the electrodes. An electrical adaptor means, such as a screw-type base, is affixed to the outer surface of the protective envelope to facilitate electrical connection of the lamp to a source of electrical power. Electrical conductor means electrically connects the electrical adaptor means to the electrical lead-in members. The foregoing lamp construction is generally conventional.

In accordance with the present invention, there is provided a thin strip-like conductor member affixed to and carried on a portion of the inner surface of the protective envelope of the lamp. This thin strip-like conductor member is fragile and will fracture upon breakage of the protective envelope, which will interrupt the electrical continuity thereof of the conductor. Electrical contact means connect the thin strip-like conductor member in series with the electrical conductor means. Breakage of the protective envelope will fracture the thin strip-like conductor member thereby interrupting the electrical path between electrical adaptor means and the electrical lead-in members to render the lamp inoperative.

BRIEF DESCRIPTION OF THE DRAWINGS

For a better understanding of the invention, reference may be had to the preferred embodiments, exemplary of the invention, shown in the accompanying drawings, in which.

DESCRIPTION OF THE PREFERRED EMBODIMENT

Figure 1:
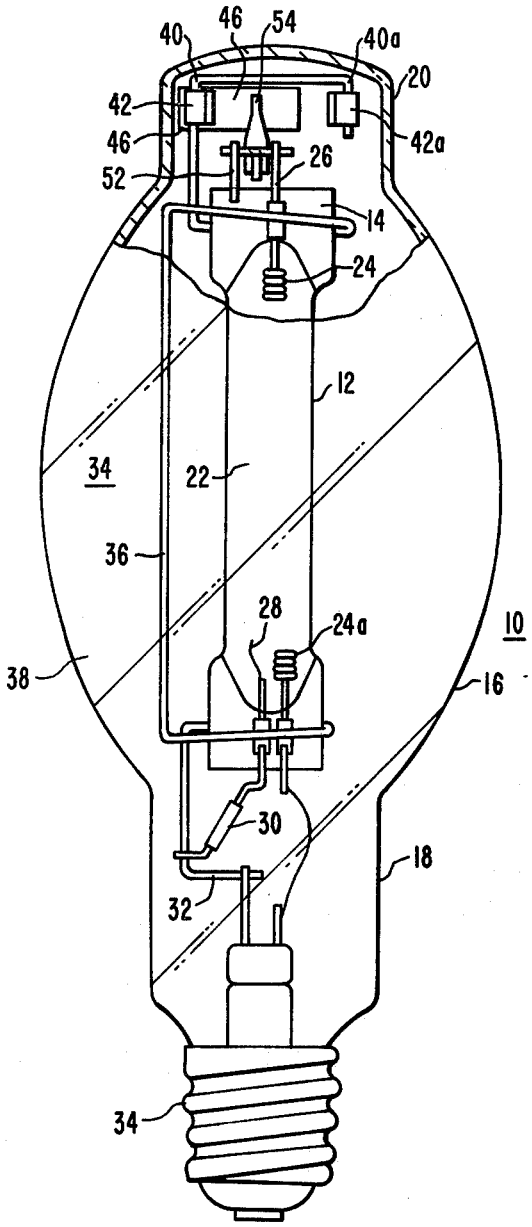
FIG. 1 is an elevational view showing a high-intensity discharge lamp with the thin strip-like conductor member extending peripherally within the dome portion of the protective envelope.

In FIG. 1, is shown a high-intensity discharge lamp which in this embodiment is a high-pressure, mercury-vapor discharge lamp 10. The lamp comprises an elongated radiation-transmitting quartz arc tube 12 which as shown in this embodiment has pressed-end portions 14, 14*a* which is longitudinally disposed and supported within an elongated light-transmitting protective envelope 16. The envelope as shown, has a neck portion 18 and a dome portion 20. The envelope 16 is formed of glass, such as borosilicate glass, which is transmissive for visible radiations and opaque with respect to the short-wavelength ultraviolet radiations which are generated within and transmitted through the arc tube 12. In accordance with conventional practices, the arc tube encloses a discharge-sustaining filling such as a small charge of mercury 22 and a small charge of inert starting gas such as four torrs of argon. The arc tube has electrodes 24, 24*a* operatively positioned therein proximate the ends thereof and electrical lead-in members 26, 26*a* sealed through the arc tube and connected to the electrodes. A starting electrode 28 is positioned at one end of the arc tube and sealed through the pressed-end portion 14*a*, and the starting electrode 28 is connected through a starting resistor 30 to the electrical conductor means 32.

Electrical adaptor means 34, such as a conventional screw-type base, is affixed to the outer surface of the protective envelope to facilitate electrical connection of the lamp 10 to a source of electrical power. The electrical conductor means 32 connects the electrical adaptor means 34 to the electrical lead-in members 26, 26*a*. The electrical conductor means 32, as shown in this embodiment, includes an arc tube supporting frame 36 which comprises an elongated rigid metallic supporting member 38 longitudinally disposed within the protective envelope 16 and having extremity portions 40, 40*a* proximate the dome portion 20 of the protective envelope 16. Flexible leaf-spring metallic members 42, 42*a* are affixed proximate the extremity portions 40, 40*a* of the rigid metallic supporting member 38 laterally extended therefrom. The end portions 44, 44*a* of the leaf-spring members 42, 42*a* are urged toward the inner surface of the dome portion 20 of the protective envelope 16 by the resiliency of the leaf-spring members to provide a lateral and somewhat resilient support for the arc tube 12. The lamp and arc tube support as described hereinbefore are generally conventional.

Figure 3:
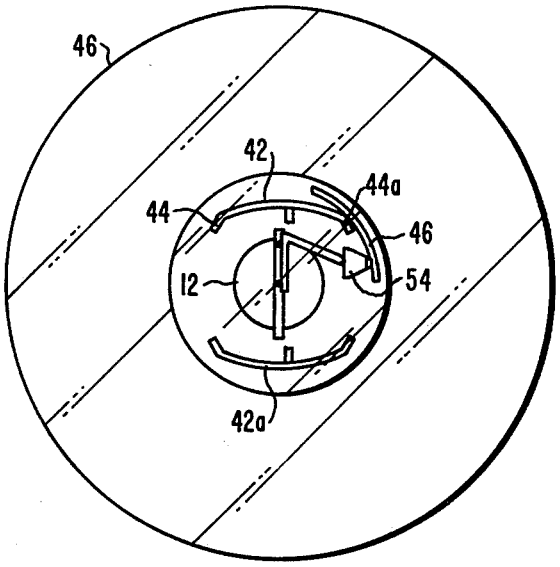
FIG. 3 is a fragmentary plan view of FIG. 2, showing the position of the thin strip-like conductor and further details of the electrical conductor means.
Figure 2:
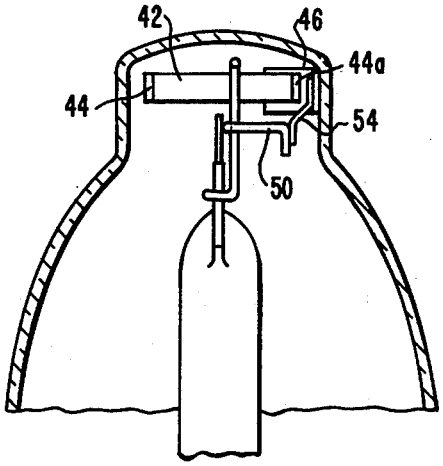
FIG. 2 is a fragmentary side elevational view of the lamp of FIG. 1, showing further details of the electrical connection to the strip-like conductor.

In accordance with one embodiment of the present invention, and referring to FIGS. 1–3, there is provided a thin strip-like conductor member 46 affixed to and carried on a portion of the inner surface of the protective envelope 16 which will normally fracture upon any breakage of the protective envelope. The thin strip-like conductor member is sufficiently fragile that it will break and interrupt the electrical continuity thereof if the protective envelope portion upon which it is carried is fractured. The thin strip-like conductor member 46 may be made of any good conductive metal, such as silver. A conductive silver stripe with a coating of screening paste on one side works well. Electrical contact means connect the thin strip-like conductor member 46 in series with the electrical conductor means 32, whereby breakage of the protective envelope 16 will fracture the thin strip-like conductor member 46 and interrupt the electrical path between the electrical adaptor means 34 and the electrical lead-in members 26, 26*a* to render the lamp 10 inoperative.

As shown in this embodiment the electrical contact means comprises an elongated connecting member 50 affixed at one end to one of the lead-in members 26 nearest the dome portion 20 of the protective envelope 16. As shown in this embodiment a supporting wire 52 preferably is embedded in the pressed-end portion 14 of the arc tube 12 proximate the dome portion of the protective envelope. The connecting member 50 is preferably affixed to the supporting wire 52 for additional strength. The connecting member 50 generally extends laterally toward the inner surface of the dome portion 20. An elongated resilient spring 54 is affixed to one end of the connecting member 50 nearest the inner surface of the envelope 16. The resilent spring member 54 extends toward the inner surface of the dome portion 20 and is urged by its resiliency to contact the same. The thin strip-like conductor member 46, as shown in this embodiment, extends peripherally within the dome portion 20 of the protective envelope 16. The thin conductor member is positioned so as to contact the resilient spring member 54 and one of the leaf-spring members 40. Electrical connection from the base 34 to the upper electrode 24 is thus through the frame 36, leaf spring 40, strip-like member 46, spring 54 and connecting member 50. Thus, breakage of the envelope 16 breaks the thin strip-like member 46 and cuts off the power to the arc tube 12.

Figure 4:
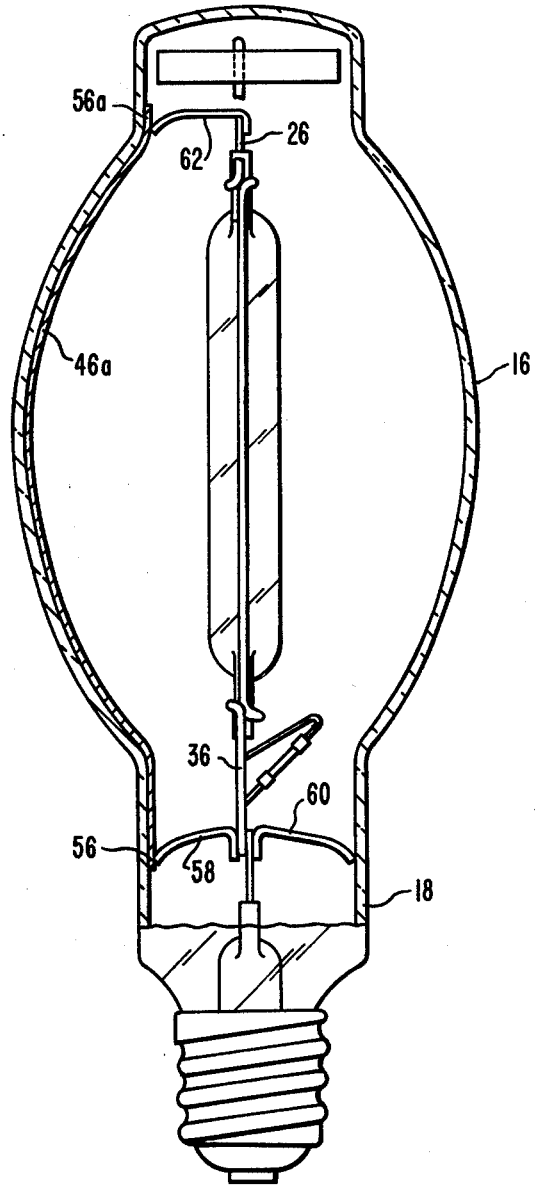
FIG. 4 is an elevational view of an alternative lamp wherein the thin strip-like conductor member extends longitudinally within the protective envelope with electrical contact means connected thereto.

In accordance with another embodiment of the present invention, and referring to FIG. 4, the thin strip-like conductor member longitudinally extends within the envelope 16. Electrical contact means, as shown in this embodiment, comprises resilient spring means comprising first, second and third spring members 58, 60 and 62. The first spring member 58 is affixed to the supporting frame 36 proximate the neck portion 18 of the protective envelope 16. The first spring member 58 is forced by its resiliency into electrical contact with an end portion 56 of the strip-like conductor 46 and the envelope inner surface. The second resilient spring member 60 is affixed to the supporting frame 36 proximate the neck portion 18 of the protective envelope 16 and laterally extends toward the inner surface of the envelope and is forced by its resiliency into contact with the envelope inner surface at a point opposite the first resilient spring member 58. The third resilient spring member 62 is affixed to one of the lead-in members 26 and the supporting wire 52 proximate the dome portion 20 and laterally extends toward the inner surface of the envelope 16 and is forced by its resiliency into electrical contact with the other end portion 56*a* of the strip-like conductor 46*a* and the inner surface of the envelope. The strip-like conductor 46*a* as so arranged is electrically in circuit with the arc tube when the envelope is intact and the lamp is rendered inoperative upon breakage of the envelope 16.

I claim:

1. In combination with a high-intensity discharge lamp comprising an elongated radiation-transmitting arc tube which is enclosed by and supported within a light-transmitting protective envelope which is opaque to short-wavelength ultraviolet radiations, said arc tube enclosing a discharge-sustaining filling and having electrodes operatively positioned therein proximate the ends thereof, electrical lead-in members sealed through said arc tube and connected to said electrodes, electrical adaptor means affixed to the outer surface of said protective envelope to facilitate electrical connection of said lamp to a source of electrical power, and electrical conductor means electrically connecting said electrical adaptor means to said electrical lead-in members, the improvement which comprises:

(a) a thin strip-like conductor member affixed to and carried on a portion of the inner surface of said protective envelope which will normally fracture upon any breakage of said protective envelope, said thin strip-like conductor member being sufficiently fragile that it will break and interrupt the electrical continuity thereof if the protective envelope portion upon which it is carried is fractured, and (b) electrical contact means connecting said thin strip-like conductor member in series with said electrical conductor means, whereby breakage of said protective envelope will fracture said thin strip-like conductor member and interrupt the electrical path between said electrical adaptor means and said electrical lead-in members to render said lamp inoperative.

2. In combination with a high-intensity discharge lamp comprising an elongated radiation-transmitting arc tube having pressed-end portions which is enclosed by and supported within a light-transmitting protective envelope having a neck portion and a dome portion and which is opaque to short-wavelength ultraviolet radiations, said arc tube enclosing a discharge-sustaining filling and having electrodes operatively positioned therein proximate the ends thereof, electrical lead-in members sealed through said arc tube and connected to said electrodes, electrical adaptor means affixed to the outer surface of said protective envelope to facilitate electrical connection of said lamp to a source of electrical power, and electrical conductor means electrically connecting said electrical adaptor means to said electrical lead-in members, said electrical conductor means including an arc tube supporting frame comprising an elongated rigid metallic supporting member longitudinally disposed within said protective envelope and having extremity portions proximate said dome portion of said protective envelope, and flexible leaf-spring metallic members affixed proximate the extremity portions of said rigid metallic supporting member and laterally extending therefrom with the end portions of said leaf-spring members urged toward the inner surface of said dome portion of said protective envelope by the resiliency of said leaf-spring members to provide a lateral and somewhat resilient support for said arc tube, the improvement which comprises:

(a) a thin strip-like conductor member affixed to and carried on a portion of the inner surface of said protective envelope which will normally fracture upon any breakage of said protective envelope, said thin strip-like conductor member being sufficiently fragile that it will break and interrupt the electrical continuity thereof if the protective envelope portion upon which it is carried is fractured, and (b) electrical contact means connecting said thin strip-like conductor member in series with said electrical conductor means, whereby breakage of said protective envelope will fracture said thin strip-like conductor member and interrupt the electrical path between said electrical adaptor means and said electrical lead-in members to render said lamp inoperative.

3. The lamp of claim 2, wherein said electrical contact means comprises an elongated connecting member affixed at one end to one of said lead-in members nearest the dome portion of said protective envelope, said connecting member generally extending laterally toward the inner surface of said dome portion, an elongated resilient spring member affixed to one end of said connecting member nearest said inner surface of said envelope, said resilient spring member extending toward said inner surface of said dome portion and urged by its resiliency to contact same.

4. The lamp of claim 3, wherein said thin strip-like conductor member extends peripherally within said dome portion of said protective envelope, said thin conductor member postioned so as to contact said resilient spring member and one of said leaf-spring members, whereby breakage of said envelope breaks said thin strip-like member and cuts off the power to said arc tube.

5. The lamp of claim 2, wherein said thin strip-like conductor member longitudinally extends within said envelope.

6. The lamp of claim 2, wherein a supporting wire is embedded in said pressed-end portion of said arc tube proximate said dome portion of said protective envelope.

7. The lamp of claim 6, wherein said elongated connecting member is also affixed to said supporting wire.

8. The lamp of claim 5, wherein said electrical contact means comprises resilient spring means comprising a first spring member affixed to said supporting frame proximate said neck portion of said protective envelope and forced by its resiliency into electrical contact with an end portion of said strip-like conductor and said envelope inner surface, a second resilient spring member affixed to said supporting frame proximate said neck portion of said protective envelope and laterally extending towards the inner surface of said envelope and forced by its resiliency into contact with said envelope inner surface at a point opposite said first resilient spring member, a third resilient spring member affixed to one of said lead-in members proximate said dome portion and laterally extending towards said inner surface of said envelope and forced by its resiliency into electrical contact with the other end portion of said strip-like conductor and the inner surface of said envelope, whereby said thin strip-like conductor is electrically conductive when said envelope is unbroken and electrically non-conductive upon breakage of said envelope.

9. The lamp of claim 8, wherein a supporting wire is embedded in said pressed-end portion of said arc tube proximate said dome portion of said protective envelope.

10. The lamp of claim 9, wherein said third resilient spring member is also affixed to said supporting wire.

* * * * *